United States Patent [19]

Tamura et al.

[11] 4,306,229

[45] Dec. 15, 1981

[54] SMOKE DETECTOR HAVING AN INTEGRAL PIEZO-ELECTRIC BUZZER

[75] Inventors: Toru Tamura, Fuchu; Toshiaki Okazaki, Tokyo, both of Japan

[73] Assignee: Nohmi Bosai Kogyo Co., Ltd., Tokyo, Japan

[21] Appl. No.: 161,911

[22] Filed: Jun. 23, 1980

Related U.S. Application Data

[63] Continuation of Ser. No. 936,913, Aug. 23, 1978, abandoned, which is a continuation of Ser. No. 777,544, Mar. 14, 1977, abandoned.

[30] Foreign Application Priority Data

Mar. 17, 1976 [JP] Japan ..... 51-31088[U]
Mar. 17, 1976 [JP] Japan ..... 51-31089[U]

[51] Int. Cl.³ ..... G08B 17/10

[52] U.S. Cl. ..... 340/629; 340/630; 340/384 E

[58] Field of Search ..... 340/629, 630, 384 E, 340/594; 250/574, 381

[56] References Cited

U.S. PATENT DOCUMENTS

| | | | |
|---|---|---|---|
| 2,048,630 | 7/1936 | Davis | 340/594 |
| 2,786,195 | 3/1957 | Colette | 340/521 |
| 2,804,609 | 8/1957 | Sussman | 340/594 |
| 3,681,603 | 8/1972 | Scheidweiler et al. | 340/630 X |
| 3,686,655 | 8/1972 | Kasahara | 340/634 |
| 3,708,675 | 1/1973 | Tashiro et al. | 340/630 X |
| 3,879,726 | 4/1975 | Sweany | 340/384 E |
| 3,895,367 | 7/1975 | Visser | 340/634 |
| 3,909,815 | 9/1975 | Gacogne | 340/629 |
| 3,919,702 | 11/1975 | Hayes et al. | 340/630 X |
| 3,922,655 | 11/1975 | Lecuyer | 340/630 |

*Primary Examiner*—John W. Caldwell, Sr.
*Assistant Examiner*—Daniel Myer
*Attorney, Agent, or Firm*—Wenderoth, Lind & Ponack

[57] ABSTRACT

A fire detector comprises a piezo-electric element attached to a vibrating portion which is part of a component constituting the detector. The component having the vibrating function may be a casing or an electrode or any other suitable member. The piezo-electric buzzer is thus incorporated in the detector to form a simple and compact fire detector with an alarm device.

8 Claims, 5 Drawing Figures

SMOKE DETECTOR HAVING AN INTEGRAL PIEZO-ELECTRIC BUZZER

This application is a continuation of now abandoned application Ser. No. 936,913, filed Aug. 23, 1978, which was in turn a continuation of now abandoned application Ser. No. 777,544, filed Mar. 14, 1977.

FIELD OF THE INVENTION

The present invention relates to fire detectors, and more particularly, to fire detectors having a fire detection system and an alarm device.

BACKGROUND OF THE INVENTION

Typical conventional fire detectors include a fire detection system which may be an ion chamber sensitive to smoke, an optical smoke detector operable in response to the scattered light or the reduced light due to the smoke emitted from a fire, a flame sensor, a burned gas sensor, or a thermally responsive element. These fire detection systems are typically coupled to a discriminator circuit suitable for the respective type of the fire detection system. When the smoke emitted from a fire enters the fire detection system within the casing through an air passage formed therein, the fire detection system detects the smoke and the discriminator circuit generates an electrical signal representative of the presence of the smoke. This electrical signal causes an alarm device to generate an alarm signal.

It has been known to provide a visual indication device, such as a lamp energized upon the detection of a fire, in a fire detector per se such as by mounting it in the base or the casing of the detector.

In order to make sure that people around the fire detector and the alarm are warned without having to look at the alarm device, various types of commercially available standardized acoustic alarm devices are usually employed in combination with a fire detector. Such acoustic alarm devices include electromagnetic buzzers, electric bells, electric horns etc. However, such fire detectors and additional alarm devices are formed as two individual devices and separately attached to the ceiling for example of the building. When desired, they may be mounted on a common base or enclosed in a common casing. However, these common bases and casings are relatively large. Therefore, conventional fire detectors having fire detection systems and alarm devices are bulky and complex in structure.

SUMMARY OF THE INVENTION

Accordingly, the object of the present invention is to provide a simple and compact fire detector with an alarm device incorporated therein.

Another object of the present invention is to provide a simple and compact fire detector with a piezoelectric buzzer.

Still another object of the present invention is to provide a simple and compact fire detector efficiently generating an acoustic signal.

With the above objects in view, the fire detector of the present invention comprises a base, a casing attached to the base for defining the smoke detection region communicated with the exterior of the casing through an opening formed in the casing, and detection means disposed in the smoke detection region for detecting the smoke which has entered into the casing and for generating an electrical signal representative of the presence of the smoke. The detection means may comprise an ion chamber formed between a pair of electrodes and an electrical circuit. Alternatively, the detection means may comprise an optical smoke detector and an electrical circuit for generating the signal indicating the presence of smoke. At least a part of one of the components constituting the fire detector is made capable of being vibrated to form a vibrating portion. A piezo-electric element is secured to the electric circuit, forming a piezo-electric buzzer, whereby the vibrating portion is caused to vibrate and generate an acoustic signal upon the detection of the smoke emitted from a fire.

BRIEF DESCRIPTION OF THE DRAWINGS

The invention will become more readily apparent from the following descriptions of the preferred embodiments of the invention taken in conjunction with the accompanying drawings, in which.

DESCRIPTION OF THE PREFERRED EMBODIMENTS

Figure 1:
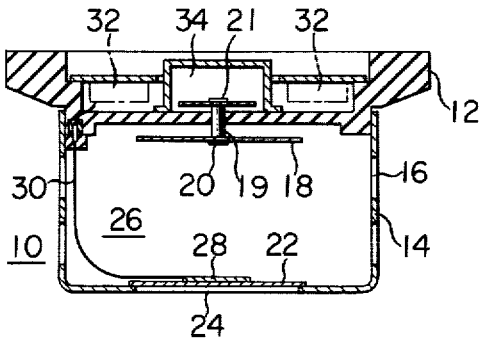
FIG. 1 is a schematic sectional view of a fire detector of the ion-chamber type constructed in accordance with the present invention.

Referring to FIG. 1 of the drawings, the fire detector of the present invention is illustrated as being an ion-chamber fire detector 10 comprising a base 12 made of a suitable insulating material and a casing 14 attached to the base 12. The casing 14 may be made of a metal or an insulating material and has on its side wall openings 16 for allowing air to enter therethrough. The base may be mounted on the ceiling of a building by any suitable conventional securing means such as screws or glue. An inner electrode 18 attached to a rod 19 secured to the base 12 and having a source 20 of radioactive rays is disposed within the casing 14. An outer electrode 22 is attached to the inner surface of the bottom wall of the casing 14 over an aperture 24 formed in the bottom wall of the casing 14. When the casing 14 is made of an insulating material, the outer electrode 22 may be secured to the casing 14 by any bonding means. When the casing 14 is made of an electrically conductive material, the outer electrode 22 is attached by an electrically conductive solder or the like at its edge portion to the casing 14. Therefore, the casing 14 serves as part of the outer electrode 22, forming an ion chamber 26 between the casing 14 having the outer electrode 22 and the inner electrode 18 with the radioactive ray source 20.

On the inner surface of the outer electrode 22, a piezo-electric element 28 is attached by a suitable insulating glue or the like. This piezo-electric element 28, together with the outer electrode 22 which also serves as a virbrating portion, forms a piezo-electric buzzer. The piezo-electric element 28 is electrically connected by a conductor 30 to a discriminator circuit 32 of the known type which is disposed within a reces of the base 12 and which includes a switching circuit for supplying a voltage signal to the piezo-electric element 28 through the conductor 30 in response to the increase of the resistance in the ion chamber 26 due to the ingress of the smoke emitted from a fire. The radioactive ionization smoke detector means may be as disclosed in the U.S. patent issued to Gacogne U.S. Pat. No. 3,909,815. When the voltage signal is supplied to the piezo-electric element 28, it causes the vibrating portion or the outer electrode 22 to vibrate, thereby generating an acoustic signal warning people at the site. Surrounding the upper end of the rod 19 having another radioactive ray source 21 attached thereto is an inner ion chamber 34.

With the arrangement as above described, the outer electrode 22 which is a part of the casing 14 has a triple function, i.e., it serves as one of the pair of electrodes, and as the casing and as the piezo-electric buzzer. Accordingly, the fire detector of the present invention has a smaller number of components and is simple in structure and compact in size compared to the conventional fire detector with an alarm device.

Figure 2:
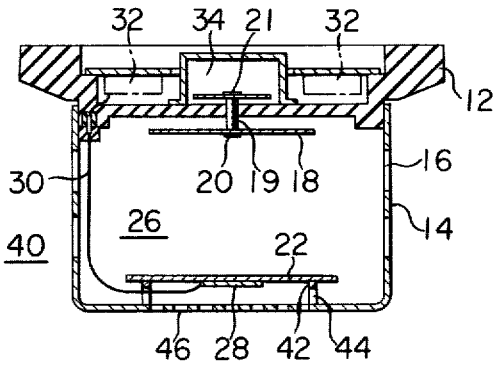
FIG. 2 is a schematic sectional view of a fire detector of the ion-chamber type of the present invention.

Another embodiment of the present invention is illustrated in FIG. 2 wherein a fire detector 40 has a similar construction to that shown in FIG. 1. One of the differences is that the outer electrode having the piezo-electric element attached on its outer surface is mounted on a hollow cylindrical member 42. The cylindrical member 42 has a plurality of openings 44 in its wall and is attached to the bottom wall of the casing 14. Another difference is that the bottom wall of the casing 14 has a plurality of openings 46 for allowing the entry of air therethrough and through the openings 44 in the hollow cylindrical member 42 into the outer ion chamber 26 which is formed between the pair of electrodes 18 and 22. The openings 46 also serve as sound holes for the vibrating plate 22. In other respects, the fire detector 40 shown in FIG. 2 is the same as the detector 10 shown in FIG. 1.

This fire detector 40 shown in FIG. 2 is advantageous over the detector 10 shown in FIG. 1 in that it has better acoustic characteristics due to the piezo-electric buzzer mounted inside the casing 14, although its structure is a little more complex.

Figure 3:
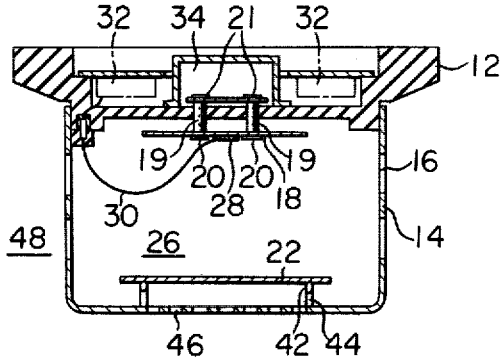
FIG. 3 is a schematic sectional view showing a modified fire detector of the present invention.

FIG. 3 shows a modified arrangement of a fire detector 48, in which the inner electrode 18 is supported on a plurality of rods 19 each having radioactive ray sources 20 and 21 attached thereon, and the piezo-electric element 28 is attached to the inner electrode 18.

Figure 4:
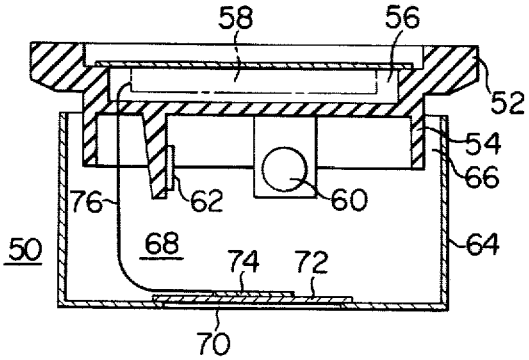
FIG. 4 is a schematic sectional view of an optical fire detector constructed in accordance with the present invention.

Referring to FIG. 4, a fire detector 50, which is still another embodiment of the present invention, comprises a base 52 having a flange 54 extending downward from the lower edge of the base 52 and a recess 56 for receiving therein a discriminator circuit 58 of the known type. The base 52 also has attached thereto a light emitting element 60 and a light sensing element 62 for receiving and sensing the light from the light emitting element 60. These two elements 60 and 62 are electrically connected to the discriminator circuit 58, thereby sensing a change in condition of the light between the two elements 60 and 62 and generating an electrical signal for actuating a piezo-electric buzzer which will be described in detail later on. The photoelectric smoke detector means may be as disclosed in the patent issued to Hayes U.S. Pat. No. 3,919,702.

A casing 64 enclosing the smoke detection region between the light emitting element 60 and the light sensing element 62 is attached to the base 52 so that the upper edge of the casing 64 forms an annular opening 66 in cooperation with the downward extending flange 54 of the base 52. This opening 66 serves as the opening for allowing the entry of smoke into a smoke detection region 68. Since the opening 66 is formed between the flange 54 and the casing 64, the smoke detection region 68 is not directly affected by light from the exterior of the casing 64. The casing 64 is mounted on the base 52 by any suitable means such as support rods, (not illustrated in drawings), extending between the casing 64 and the base 52 or the flange 54 of the base 52.

The casing 64 has an opening 70 formed in its bottom wall, and the opening 70 is covered by a vibrating plate 72 secured at its edge to the edge of the opening 70 by means of glue or the like. The vibrating plate 72 has a piezo-electric element 74 secured thereon by electrically insulative glue or the like, and the piezo-electric element 74 is electrically connected by means of a conductor 76 to the discriminator circuit 58. Thus, the vibrating plate 72 and the piezo-electric element 74 connected to the discriminator circuit 58 constitute a piezo-electric buzzer incorporated into the casing 64. The vibrating plate 72 has a double function, i.e., as a part of the casing for preventing exterior light from entering into the smoke detection region 68 and as a piezo-electric buzzer.

Figure 5:
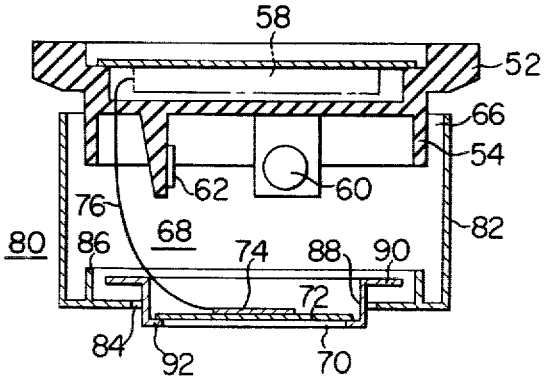
FIG. 5 is a schematic sectional view of another optical fire detector embodying the present invention.

FIG. 5 shows another fire detector 80 which is similar to that illustrated in FIG. 4 except for the arrangement of the bottom portion of the casing 82. The casing 82 has in its bottom wall a circular opening 84 and has on the inner surface an annular riser flange 86 surrounding the opening 84. A hollow cylindrical member 88 is concentrically disposed in the opening 84 so that it forms an annular opening between the casing 82 and the cylindrically member 88. The inner edge of the cylindrical member 88 has a radially outwardly extending flange 90, and the outer edge of the cylindrical member 88 has a radially inwardly extending flange 92 defining a circular opening 70. This opening 70 is closed by the vibrating plate 72 having the piezo-electric element 74 secured thereon. In other respects the arrangement is the same as that illustrated in FIG. 4.

What is claimed is:

1. A smoke detector comprising:

a base;

a housing having at least one aperture, said housing operatively connected to said base, said base and said housing forming a smoke detection region therebetween;

first and second electrodes, respectively operatively mechanically connected to said base and said housing, whereby said smoke detection region is between said first and second electrodes;

a radiation source located within said smoke detection region and operatively connected to said base for emitting radiation in said smoke detection region;

a detector circuit means electrically operatively connected to said first and second electrodes for providing an electrical signal in response to smoke entering said smoke detection region through said at least one aperture, said smoke affected by said emitted radiation;

a piezo-electric element operatively mechanically connected to one of said first and second electrodes and electrically connected to said detector circuit means, said piezo-electric element vibrating said one of said first and second electrodes to which it is mechanically operatively connected in response to said electrical signal from said detector circuit means for producing an audible alarm, whereby said audible alarm is indicative of the presence of smoke.

2. A smoke detector as in claim 1, wherein said radiation source is mounted within a cylindrical rod, said rod operatively mechanically connecting one of said first and second electrodes to said base.

3. A smoke detector as in claim 1, wherein part of said housing forms one of said first and second electrodes.

4. A smoke detector as in claim 1, wherein said second electrode is mechanically connected to said housing so as to partially cover said at least one aperture.

5. A smoke detector as in claim 4, further comprising a ring member, said ring member mechanically connecting said second electrode to said housing.

6. A smoke detector comprising:

a base;

a housing having at least one aperture, said housing operatively connected to said base, said base and said housing forming a smoke detection region therebetween;

a light emitter source located within said smoke detection region and operatively connected to said base for emitting light in said smoke detection region;

a detector means including a light sensor mechanically operatively connected to said base for providing an electrical signal in response to smoke entering said smoke detection region through said aperture;

a piezo-electric element operatively mechanically connected to said housing and electrically connected to said detector means, said piezo-electric element vibrating a portion of said housing in response to said signal from said detector means for producing an audible alarm, whereby said audible alarm is indicative of the presence of smoke.

7. A smoke detector as in claim 6, wherein said portion of said housing vibrated by said piezo-electric element comprises a vibrating plate mechanically connected over an aperture in said housing.

8. A smoke detector as in claim 6, wherein said vibrating portion of said housing comprises a hollow cylindrical member having a vibrating plate mounted thereon, said vibrating plate spaced apart from an aperture in said housing, and wherein said hollow cylindrical member comprises said at least one aperture, whereby smoke enters said smoke detection region through said hollow cylindrical member.

* * * * *